US007461706B2

(12) United States Patent
Eddison

(10) Patent No.: US 7,461,706 B2
(45) Date of Patent: Dec. 9, 2008

(54) DRILLING APPARATUS WITH PERCUSSIVE ACTION CUTTER

(75) Inventor: Alan Martyn Eddison, Stonehaven (GB)

(73) Assignee: Andergauge Limited, Aberdeen (GB)

( * ) Notice: Subject to any disclaimer, the term of this patent is extended or adjusted under 35 U.S.C. 154(b) by 0 days.

(21) Appl. No.: 11/691,151

(22) Filed: Mar. 26, 2007

(65) Prior Publication Data

US 2007/0181340 A1 Aug. 9, 2007

Related U.S. Application Data

(63) Continuation of application No. 10/488,216, filed on Aug. 31, 2004, now abandoned.

(30) Foreign Application Priority Data

| | | |
|---|---|---|
| Jun. 5, 2001 | (GB) | 0113585.4 |
| Jun. 19, 2001 | (GB) | 0114874.1 |
| Jun. 5, 2002 | (WO) | PCT/GB02/02575 |

(51) Int. Cl.
*E21B 7/00* (2006.01)
*E21B 47/00* (2006.01)

(52) U.S. Cl. ..... 175/57; 175/296; 175/297; 175/415

(58) Field of Classification Search ..... 175/57, 175/296, 297, 415
See application file for complete search history.

(56) References Cited

U.S. PATENT DOCUMENTS

| | | | | |
|---|---|---|---|---|
| 2,819,041 | A | 1/1958 | Beckham | |
| 2,873,093 | A | 2/1959 | Hildebrandt | |
| 2,942,579 | A | 6/1960 | Morrison | |
| 2,942,851 | A | 6/1960 | Beck | |
| 3,066,749 | A | 12/1962 | Hildebrandt | |
| 3,297,099 | A | 1/1967 | Adams et al. | |
| 3,387,673 | A | 6/1968 | Thompson | |
| 3,429,390 | A | 2/1969 | Bennett | |
| 3,807,512 | A | 4/1974 | Pogonowski et al. | |
| 6,186,248 | B1 * | 2/2001 | Silay et al. | 175/27 |

FOREIGN PATENT DOCUMENTS

| | | |
|---|---|---|
| DE | 3819462 | 5/1990 |
| DE | 197 36 858 | 1/1999 |
| DE | 199 50 599 | 3/2001 |
| GB | 222822 | 6/1925 |
| GB | 2 345 931 | 7/2000 |
| SU | 1730420 | 4/1992 |

OTHER PUBLICATIONS

International Search Report for PCT/GB02/02575 completed Jul. 26, 2002.

* cited by examiner

*Primary Examiner*—David J Bagnell
*Assistant Examiner*—Nicole Coy
(74) *Attorney, Agent, or Firm*—Alston & Bird LLP

(57) ABSTRACT

A drilling apparatus includes a cutting structure defined by a percussive action cutter and at least one other cutter. The percussive action cutter is adapted to be urged in a drilling direction by hydraulic pressure force, while the other cutter is urged in a drilling direction by mechanical force.

37 Claims, 5 Drawing Sheets

DRILLING APPARATUS WITH PERCUSSIVE ACTION CUTTER

CROSS-REFERENCE TO RELATED APPLICATIONS

This application is a continuation of U.S. application Ser. No. 10/488,216, which was filed Aug. 31, 2004, now abandoned and which is incorporated herein by reference. This application and the Ser. No. 10/488,216 application claim the benefit of priority of each of International Application No. PCT/GB02/02575, filed Jun. 5, 2002 and published as WO 02/099242 A1 on Dec. 12, 2002, United Kingdom (GB) Application No. 0113585.4, filed Jun. 5, 2001, and United Kingdom (GB) Application No. 0114874.1, filed Jun. 19, 2001.

FIELD OF THE INVENTION

Embodiments of the invention relate to drilling apparatuses, and in particular to drilling apparatuses for use in drilling bores in earth formations.

BACKGROUND OF THE INVENTION

Conventional drill bits, as used for example in the drilling of bores in the oil and gas exploration and production industry, feature a number of toothed roller cones. In use, weight is applied to the rotating bit, and the cones roll over the circular face forming the end of the bore. The cutting of the rock is achieved by a number of mechanisms, including a crushing action, the crushed rock then being removed from the cutting face by the action of drilling fluid exiting the drill bit via appropriately directed jetting nozzles. In addition, by varying the orientation of the rotational axes of the cones, it is possible to provide a scraping or scouring action as the cones rotate.

A more recent development, allied to advancements in drilling and materials technology, has lead to the development of drill bits featuring fixed cutting faces provided with relatively hard materials, typically polycrystalline diamond compact (PDC).

Traditionally, drilling of the deep bores required in the oil and gas industry relied solely upon applied weight, which weight may be applied from surface, or achieved simply by the mass of the drill string, drill collars and other tools and devices above the bit. However, in recent years drilling has commenced in areas featuring particularly hard rock, in which drilling using conventional methods is still possible, but relatively slow. In attempts to overcome this problem, there have been various proposals for percussive or hammer drill bits; while air-powered hammer drills are in common use in, for example, the construction trades and in mining, drilling of deep bores with non-compressible drilling fluid poses many different and varied problems. One difficulty has been in reliably achieving the necessary impact forces at the bit. The limited diameter available downhole limits the size of the hammer tool, resulting in excessive loading and wear on the tool in order to achieve the required impact force. Another difficulty that has been experienced in percussive bits is the tendency for the bits to "lose gauge", that is the outer edges of the bits wear prematurely, with the result that the bit drills a smaller diameter bore than intended, or must be replaced at frequent intervals.

SU 1730420 A1 (Leningrad Scientific-Research & Design Institute "Gipronikel") discloses a combined percussive rotary drilling tool. In addition to a conventional roller-cutter, the tool features a central percussive bit which cooperates with a piston actuated by a supply of compressed air. Clearly, such an arrangement would not be suitable in downhole operations where there is no supply of compressed air available; conventionally, drilling "mud" is supplied to the drill bit, which liquid could not be utilised to operate a piston as disclosed in this document.

U.S. Pat. No. 3,807,512 discloses a percussion-rotary drilling mechanism with a rotary drill bit and a percussion drill bit. A mud drive turbine is utilised to generate reciprocal motion of the percussion drill bit via an arcuate cam and cam follower drive mechanism or a rotatable eccentrically weighted wheel drive mechanism.

BRIEF SUMMARY OF THE INVENTION

It is among the objectives of embodiments of the present invention to provide an improved drilling apparatus which provides or at least facilitates a greater degree of control in a drilling apparatus having a percussive action cutter provided in combination with another form of cutter.

According to a first aspect of the present invention there is provided drilling apparatus comprising a cutting structure defined by at least one percussive action cutter and at least one other cutter, the at least one percussive action cutter being adapted to be urged in a drilling direction by hydraulic pressure force.

The combination of a percussive action cutter with a cutter of another form, such as a roller cone or a fixed cutter, such as a PDC cutter, offers many advantages over conventional drilling apparatus and drill bits. For example, the hammer action of percussive bits is most effective working with relatively light weight applied to the bit, however this may limit the cutting effectiveness of the bit, such that in conventional hammer bits a balance must be struck between these two requirements. However, in the present invention the other cutter may bear a significant proportion of the weight applied to the bit, allowing the percussive action cutter to operate more effectively. Indeed, in preferred embodiments of the present invention, substantially all of the mechanical force normally applied to the apparatus, whether by force applied to a drill string from surface or due to the mass of drill collars, the drill string and the like, is applied to or borne by the other cutter. The "weight" applied to the percussive action cutter is a function of applied hydraulic pressure, equivalent to the "pump-open force", and thus may be controlled independently of the weight applied to the other cutter, and solely with a view to maximising the effectiveness of the percussive action cutter. This division of force between the cutters also serves to utilise the different forces available, that is mechanical force and hydraulic force, in an efficient and effective manner.

Furthermore, as the percussive action cutter only provides a proportion of the area of the cutting face, for a given available hammer or percussive force the impact pressure force applied by the relatively small area percussive cutter to the rock may be relatively high. This effect may be further accentuated by the ability to create a hammer or percussive action within the body of the apparatus over an area which is relatively large when compared to the cutting area of the percussive action cutter. In conventional percussive drill bits, the hammer tool diameter is always substantially smaller than the cutting area of the bit, as the bit has to cut a bore of a gauge large enough to accommodate a drilling fluid return annulus and the body of the tool. In embodiments of the present invention the hammer tool may be at least as large as the cutting area. Of course other embodiments of the invention may achieve a hammer or percussive effect in other ways, as will be apparent to those of skill in the art.

Preferably, the apparatus includes means for creating a percussive force and means for transferring the resulting percussive force to the at least one percussive action cutter. Typically, the means for creating a percussive force will comprise a hammer tool, and the percussive action cutter will define an anvil. Conveniently, the hammer tool will be hydraulically actuated, although other forms of actuation may be employed if desired.

Preferably, the percussive action cutter defines a flow restriction, such that hydraulic fluid flowing therethrough experiences a pressure drop, and thus creates a pressure force on the cutter. The restriction may take any appropriate form, and will typically be provided by one or more jetting nozzles. The flow restriction may be provided in combination with a piston area, which piston area may also serve as an anvil.

Preferably, there is a degree of overlap in the area swept by the cutting surface of the percussive action cutter and the other cutter. Thus, if there is a loss of gauge through wear to the percussive action cutter, this will be accommodated by the other cutter.

The percussive action cutter may be located to cut a central portion of the bore. Due to the relatively low speed of a rotating drill bit at the bit centre, there are often difficulties experienced in cutting the centre of the bore. Thus, by locating the percussive action cutter centrally, the enhanced cutting action provided by the hammer drill effect will avoid this difficulty. Furthermore, it is generally desirable to rotate percussive action cutters at relatively low speed (10 to 40 rpm), the primary reason for rotation being to expose fresh formation to the individual cutter elements, with higher speeds leading to excessive or accelerated wear of the cutting elements. Merely by locating the percussive action centrally, the linear speed experienced by the cutter elements is of course relatively low in comparison to the other cutters located radially outwardly of the percussive action cutters, which other cutters typically benefit from higher cutting speeds (150 to 200 rpm). Alternatively, or in addition, the percussive action cutter may be biassed rearwardly, conveniently by means of a spring, or otherwise configured, such that the percussive action cutter is normally held slightly off bottom and thus remains in contact with the formation only for the duration of the hammer impact or impulse. The percussive action cutter will thus only make contact with the formation periodically, and for only a fraction of the time the other cutter remains in contact with the formation. This will reduce the rubbing action and wear experienced by the percussive action cutter, even at higher rotary speeds, allowing the apparatus to be rotated at speeds suited to the other cutter without damaging the percussive action cutter.

A centrally located percussive action cutter may also have a cutting face located forwards of the cutting face of the other cutter, such that the percussive action cutter effectively cuts a pilot hole in the centre of the bore. Of course this facilitates the dislodgement of rock by the following cutter. Furthermore, by providing lateral fluid outlets on the percussive action pilot cutter, ahead of the other cutter, drilling fluid may be injected into the rock formation ahead of the other cutter, facilitating the release of cuttings by the following cutter.

In light of the possibility of the different forms of cutter achieving different cutting speeds, the apparatus may include one or more of the following features.

Means may be provided for indicating that the other cutter is cutting at a faster rate than the percussive action cutter, allowing, for example, the weight applied to the other cutter to be reduced, thus reducing the cutting speed of the other cutter, improving the cutting efficiency of the percussive action cutter, and preventing premature damage and wear to the percussive action cutter, which may have been experiencing excessive applied weight. Such means may take the form of fluid outlets which are closed if the percussive action cutter experiences elevated weight and is forced rearwardly into the body of the apparatus. The resulting change in back pressure will be detectable at surface, allowing remedial action to be taken.

In circumstances where the percussive action cutter is cutting faster that the other cutter, extension of the cutter beyond a predetermined relative position may result in the associated percussive tool ceasing hammering, allowing the other cutter to catch up; it is a standard feature in many percussion tools that if the tool is picked up off bottom the tool ceases hammering. Alternatively, in a hammer and anvil arrangement the anvil on the cutter may simply move beyond the end of the hammer stroke.

A centrally located percussive action cutter may be retractable or removable, to allow the cutting of cores by the remaining cutter, to allow passage of other tools or devices through the apparatus, or to facilitate flow of, for example, cement slurry, through the apparatus. Thus, the drilling apparatus may be utilised as a casing shoe. In such applications it is likely that the shoe will be provided with fixed reaming cutters, typically PDC cutters, which tend to require a high applied torque to rotate the cutters to ream out obstructions to the passage of the shoe and following casing; however, casing, and casing threads, tend not to be capable of accommodating elevated torques. By providing a percussive action cutter in the shoe, centrally or otherwise located, the torque required to rotate the shoe may be reduced.

According to another aspect of the present invention there is provided a drilling method comprising the steps:

providing drilling apparatus comprising a cutting structure defined by at least one percussive action cutter and at least one other cutter; and urging the least one percussive action cutter in a drilling direction by hydraulic pressure force.

BRIEF DESCRIPTION OF THE SEVERAL VIEWS OF THE DRAWINGS

These and other aspects of the present invention will now be described, by way of example, with reference to the accompanying drawings, in which.

DETAILED DESCRIPTION OF THE INVENTION

Figure 1:
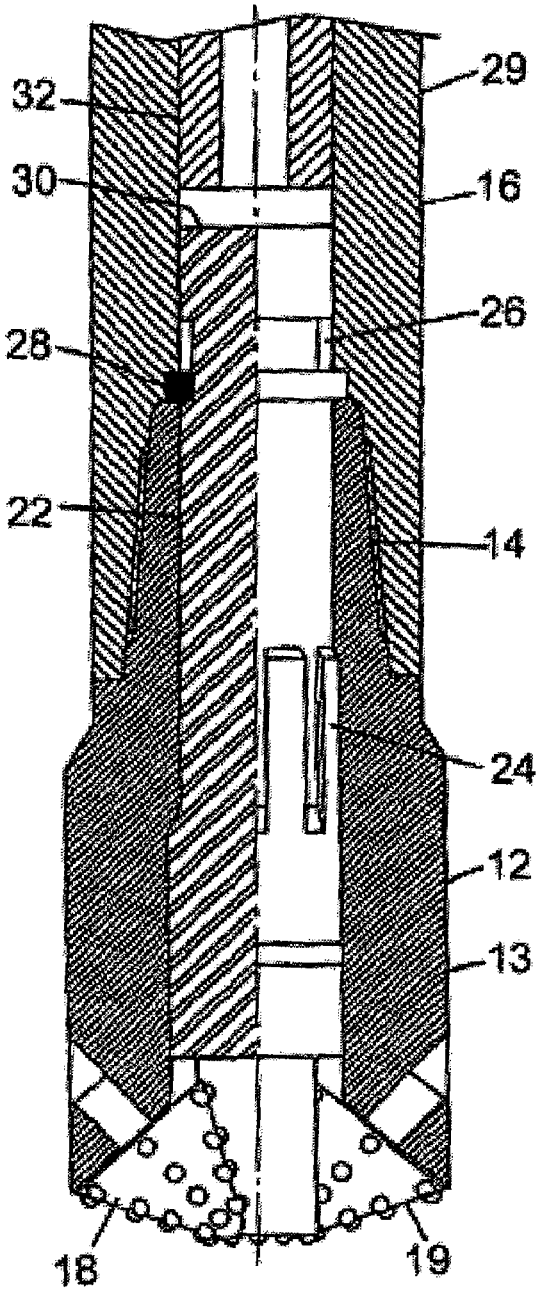
FIG. 1 is a sectional view of a part of a drilling apparatus in accordance with a first embodiment of the present invention.
Figure 2:
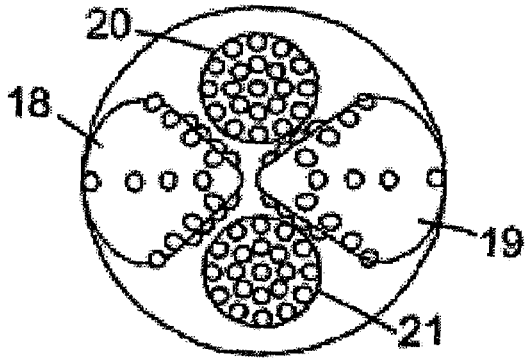
FIG. 2 is a view from below of the apparatus of FIG. 1.
Figure 3:
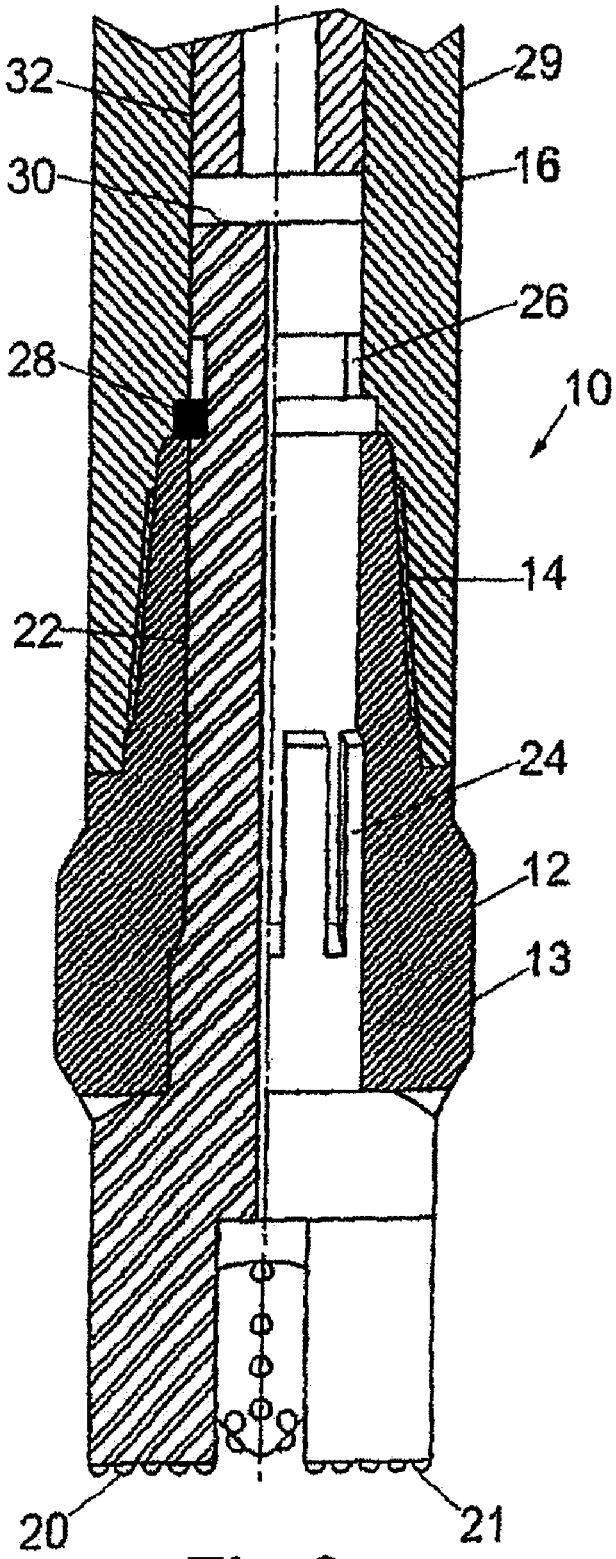
FIG. 3 is an alternative sectional view of the drilling apparatus of FIG. 1.

Reference is first made to FIGS. 1, 2 and 3 of the drawings, which show a drilling apparatus 10 in accordance with a first embodiment of the present invention. The apparatus 10 comprises a bit 12 mounted via a pin and box connection 14 to the lower end of a hammer tool 16.

Mounted on the lower end of the drill bit are two roller cones 18, 19; when the bit 12 is rotated, the cones 18, 19 will roll over the rock formation below the bit 12, crushing or otherwise dislodging cuttings from the rock. The cutting structure of the bit 12 is further defined by two circular cutting faces defined by the ends of a pair of percussive action cutters 20, 21. As may be seen from FIG. 2, the roller cones 18, 19 are positioned on opposite sides of the bit 12, and the percussive action cutters 20, 21 are located in the quadrants between the roller cones 18, 19.

Both percussive action cutters 20, 21 are mounted on the end of a mandrel 22 which extends through the bit body and into the hammer tool 16. The mandrel 22 is splined, at 24, and co-operates with the bit body 13 such that the mandrel 22 may move axially relative to the body 13, but cannot rotate relative to the bit 12. An upper portion of the mandrel 22 defines an annular recess 26 which co-operates with a ring 28 trapped between the hammer tool body 29 and the bit body 13, to limit the axial movement of the mandrel 22.

The upper end face of the mandrel 22 defines an anvil 30 against which impacts a hammer 32. Reciprocal movement of the hammer 32 may be achieved by any appropriate means, and may utilise pressure forces created by the pressure of drilling fluid within the drill string. The drilling fluid passes through the apparatus 10 and exits the apparatus through various appropriate jetting nozzles adjacent the cutters 21, 22 and the roller cones 18, 19. The drilling fluid passes through the mandrel 22 and, with the pressure drop resulting from the fluid passing through the nozzles, creates a pressure force which acts on the upper area of the anvil 30 and thus urges the cutters 21, 22 in a drilling direction with a force proportional to the drilling fluid pressure.

In use, the apparatus 10 will be run downhole on the end of an otherwise conventional drillstring. Drilling fluid will be pumped from surface and will travel through the string, the hammer tool 16 and the bit 12, to exit the bit through appropriate jetting nozzles (not shown in FIG. 1 to 3), as noted above. The bit 12 is rotated such that the roller cones 18, 19 are rolled over the end face of the bore, cutting the rock formation therebelow in a conventional manner. However, the impact of the hammer 32 on the anvil 30 will produce a percussive or hammer action which is transferred via the mandrel 22 to the percussive action cutters 20, 21. Thus, as the drill bit 12 rotates, the cutters 20, 21 are urged into the rock formation with an impact force.

It is believed that the combination of the cutting action provided by the roller cones 18, 19 and the percussive hammer action of the cutters 20, 21 will be more effective than the action of, for example, a drill bit featuring only roller cones, particularly when drilling through relatively hard formations. Furthermore, the mechanical weight applied to the bit 12 will be supported by the roller cones 18, 19, such that the applied weight may be relatively high without detracting from the hammer action of the cutters 20, 21: as noted above, the "weight" applied to the cutters 20, 21, and on top of which the impact or impulse is applied, is a function of the hydraulic pressure of the drilling fluid, and may be controlled independently of the applied mechanical weight to provide efficient percussive drilling. Furthermore, the cutting area of the percussive action cutters 20, 21 is relatively small when compared to the size of the hammer tool 16, such that the percussive or impact pressure force applied to the rock formation will be relatively high.

Figure 4:
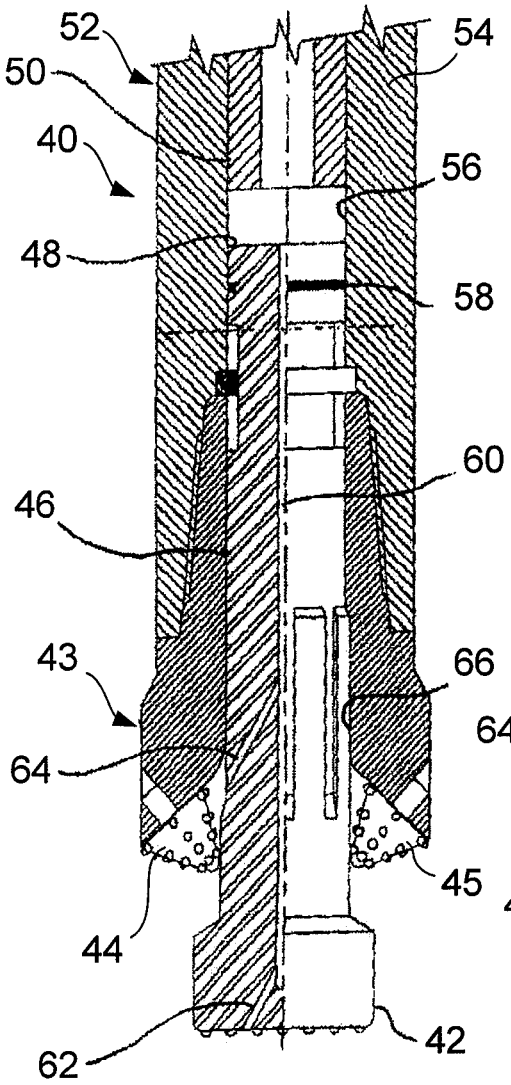
FIGS. 4 and 5 are sectional views of a part of a drilling apparatus in accordance with a second embodiment of the present invention.
Figure 5:
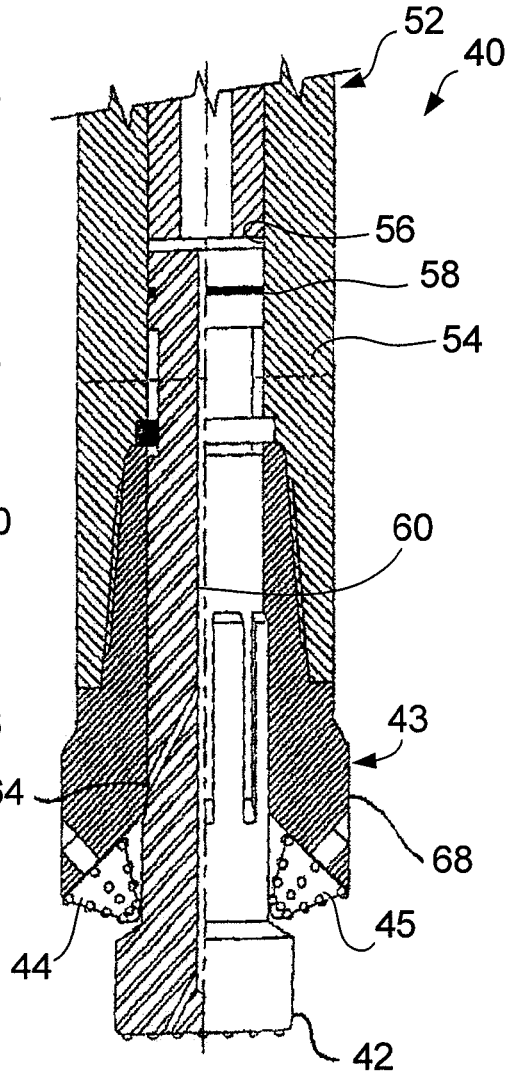

Reference is now made to FIGS. 4 and 5 of the drawings, which illustrates drilling apparatus 40 in accordance with a second embodiment of the invention. The apparatus 40 shares a number of features with the apparatus 10 described above, however in this apparatus 40 only a single percussive action cutter 42 is provided, and the cutter 42 is located centrally of the drill bit 43. Thus, in the course of a drilling operation, the percussive action cutter 42 will cut a pilot bore, and the following roller cone cutters 44, 45 will effectively provide a reaming operation to bring the bore out to gauge.

The cutter 42 is mounted on the lower end of a mandrel 46, the upper end of which defines an anvil 48 which is struck by the hammer 50 of the percussive tool 52 provided above the apparatus 40. The tool body 54 defines a bore 56 and the anvil 48 features a seal 58 which provides a sliding seal between the bore 56 and the anvil 48; as with the previous embodiment, the "weight" or force normally applied to the cutter 42 is therefor dependant on the internal fluid pressure acting on the seal area of the anvil 48.

The figures also illustrate a central bore 60 passing through the mandrel 46, the bore 60 leading to appropriately located jetting nozzles 62, 64. In use, the jetting nozzles 62 located in the face of the percussive action cutter 42 will inject pressurised drilling fluid into the walls of the pilot bore created by the cutter 42, thus facilitating cuttings removal by the cones 44, 45. If desired, jetting nozzles may be provided on the sides of the cutter 42, such that drilling fluid is directed laterally of the cutter 42, directly into the surrounding formation.

The other jetting nozzles 64 are directed towards the cones 44, 45, and are normally located below the end of the bit body bore 66, which forms a continuation of the hammer tool body bore 56. However, if the cutter mandrel 46 moves rearwardly into the bit body 68, the nozzles 64 are closed, and which may be identified at surface by an increase in the back pressure of the drilling fluid.

The presence of the percussive action cutters 42 in the centre of the bit avoids the difficulties normally associated with drilling the centre of the bore using a conventional bit. Furthermore, in the event of loss of gauge of the cutter 42, it is apparent from FIGS. 4 and 5 that such a reduction in diameter of the cutter 42 would have no significant effect, as the swept area of the roller cones 44, 45 overlaps the outer edge of the cutter 42.

Furthermore, if the cutting rate of the cones 44, 45 should exceed the cutting rate of the cutter 42, and the cones 44, 45 "catch up" with the cutter 42, as illustrated in FIG. 5, the action of the hammer tool may be affected, and the cutter 42 may experience a potentially damaging increase in applied weight. In this event, as noted above, the nozzles 64 are closed and an increase in back pressure will be noted at surface. The operator is therefore alerted to reduce the applied weight, slowing the cutting speed of the cones 44, 45, for example by reducing the mechanical weight applied to the cones 44, 45, and allowing the cutter 42 to move ahead of the cones 44, 45, to the normal, optimum drilling position.

On the other hand, if the cutting rate of the cutter 42 should exceed the cutting rate of the cones 44, 45, the anvil 48 will move towards or even beyond the end of the stroke of the hammer 50, such that the energy transferred to the cutter 42 will be reduced, and the cutting rate of the cutter 42 will decrease. In other embodiments, the percussion tool may include a control which stops the hammering action when the reaction weight or force experienced by the tool or tool bit, in the form of cutter 42, falls below a predetermined level.

Figure 6:
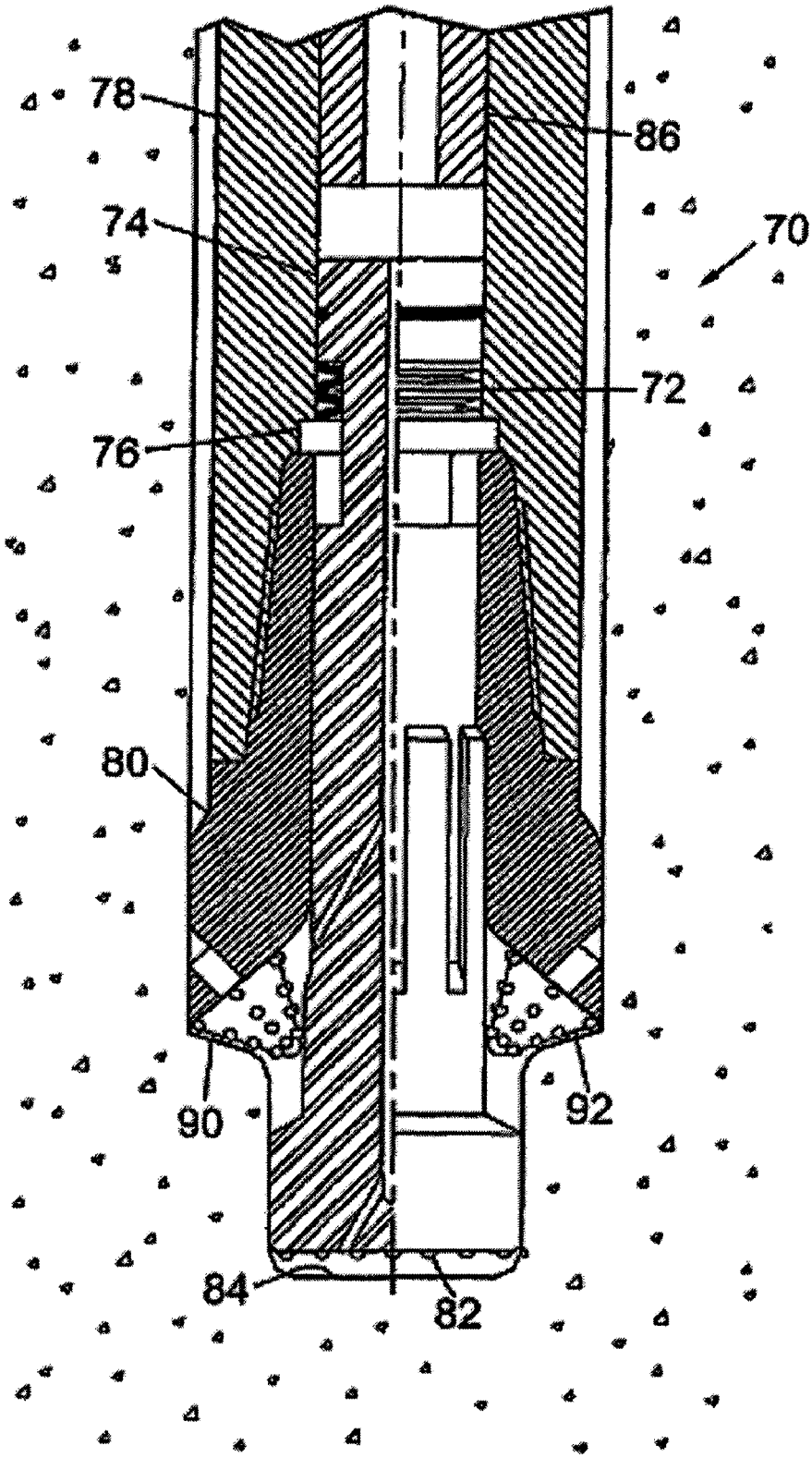
FIG. 6 is a sectional view of a part of a drilling apparatus in accordance with a third embodiment of the present invention.

Reference is now made to FIG. 6 of the drawings, which illustrates, in section, a view of a part of a drilling apparatus 70 in accordance with a third embodiment of the present invention. The apparatus 70 shares many features with the apparatus 40 described above, and additionally includes a spring 72 provided between a shoulder on the anvil 74 and the ring 76 trapped between the lower end of the hammer tool body 78 and the upper end of the bit body 80. The spring 72 is selected such that the percussive action cutter 82 is normally held slightly off bottom 84, as illustrated. The cutter 82 thus only contacts the bore bottom 84 when the hammer 86 strikes the anvil 74 and drives the bit ahead such that the cutter 82 impacts the formation. The cutter 82 is thus touching the bottom of the hole only for the duration of the hammer blow, and when the hammer 86 moves away from the anvil 74 the cutter 82 springs back off the bottom of the hole.

This feature of the apparatus 70 reduces the rubbing action and wear experienced by the cutter 82, such that the apparatus 70 may safely be rotated at a relatively high speed better suited to the cutting action of the cone cutters 90, 92; typically 150 to 200 rpm, rather than the relatively slow speeds (10 to 40 rpm) normally utilised in percussive drilling.

Figure 7:
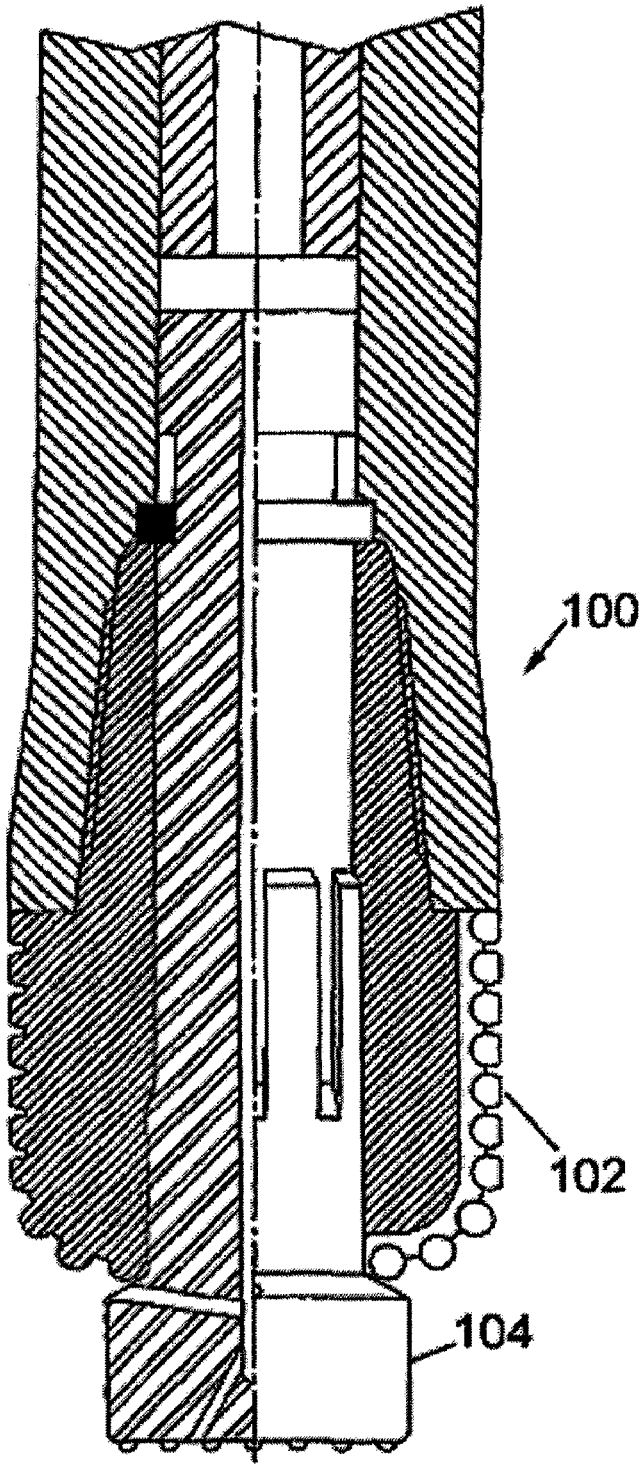
FIG. 7 is a sectional view of a part of a drilling apparatus in accordance with a fourth embodiment of the present invention.

Reference is now made to FIG. 7 of the drawings, which illustrates drilling apparatus 100 in accordance with a third embodiment of the present invention. The apparatus 100 shares a number of similarities with the embodiments described above, however rather than featuring roller cones, the apparatus 100 is provided with a fixed cutting structure provided with polycrystalline diamond compacts (PDCS) 102.

As with the apparatus 40 described above, the apparatus 100 features a centrally located percussive action cutter 104 which will, in use, cut a pilot bore ahead of the PDC cutters 102.

Conventional drill bits provided with aggressive PDC cutters normally require application of relatively high torques, which may create difficulties in certain drilling situations. However, in this embodiment of the present invention, the provision of the percussive action cutter 104 will tend to reduce the torque necessary to rotate the apparatus 100, as a proportion of the cutting is being performed by the percussive action cutter 104, which requires a relatively low input torque.

It will be clear to those of skill in the art that the above embodiments of the present invention, in which one or more percussive action cutters are combined with other cutters in a single drilling apparatus, offers numerous advantages over the prior art.

It will also be apparent to those of skill in the art that the above embodiments are merely exemplary of the present invention, and that various modification and improvements may be made thereto without departing from the scope of the invention. For example, the particular configuration of the apparatus may vary from the configurations described above, and embodiments of the invention may be provided in forms other than drill bits, for example as reamers or shoes.

That which is claimed:

1. A drilling apparatus comprising:

a cutting structure defined by at least one percussive action cutter and at least one other cutter, the at least one percussive action cutter being adapted to be urged in a drilling direction by hydraulic pressure force; and a surface indicator to alert that the other cutter is cutting at a faster rate than the percussive action cutter.

2. The apparatus of claim 1, wherein a plurality of percussive action cutters are provided.

3. The apparatus of claim 1, wherein the at least one other cutter comprises a roller cone.

4. The apparatus of claim 1, wherein the at least one other cutter comprises a plurality of roller cones.

5. The apparatus of claim 1, wherein the at least one other cutter comprises a fixed cutter.

6. The apparatus of claim 5, wherein the fixed cutter is a PDC cutter.

7. The apparatus of claim 1, wherein the at least one other cutter comprises a plurality of fixed cutters.

8. The apparatus of claim 1, wherein, in use, the at least one other cutter is adapted to support at least the majority of mechanical weight applied to the apparatus.

9. The apparatus of claim 1, further including means for creating a percussive force and means for transferring the resulting percussive force to the at least one percussive action cutter.

10. The apparatus of claim 9, wherein said means for creating a percussive force comprises a hammer tool.

11. The apparatus of claim 10, wherein the means for transferring the resulting percussive force to the at least one percussive action cutter comprises an anvil.

12. The apparatus of claim 10, wherein the hammer tool is hydraulically actuated.

13. The apparatus of claim 1, wherein the percussive action cutter defines a flow restriction, such that hydraulic fluid flowing therethrough experiences a pressure drop, and thus creates a pressure force on the cutter.

14. The apparatus of claim 13, wherein the restriction comprises at least one jetting nozzle.

15. The apparatus of claim 14, wherein the flow restriction is provided in combination with a piston area defined by the percussive action cutter.

16. The apparatus of claim 15, wherein the piston area serves as an anvil.

17. The apparatus of claim 1, further comprising a hydraulically actuated hammer tool defining a fluid pressure responsive piston area of dimensions comparable to the cutting area of the at least one percussive action cutter.

18. The apparatus of claim 17, wherein the hammer tool is at least as large as the cutting area of the at least one percussive action cutter.

19. The apparatus of claim 1, wherein there is a degree of overlap in the area swept by the cutting surface of the at least one percussive action cutter and the at least one other cutter.

20. The apparatus of claim 1, wherein a percussive action cutter is located to cut a central portion of a bore.

21. The apparatus of claim 1, wherein at least one percussive action cutter has a cutting face located forwards of the cuffing face of the at least one other cutter.

22. The apparatus of claim 21, wherein said at least one percussive action cutter includes laterally directed drilling fluid outlets ahead of the at least one other cutter.

23. The apparatus of claim 1, wherein the at least one percussive action cutter is retractable or removable.

24. The apparatus of claim 1, wherein the at least one percussive action cutter is axially moveable relative to the at least one other cutter.

25. The apparatus of claim 24, wherein movement of the at least one percussive action cutter beyond a predetermined relative axial position is operator detectable.

26. The apparatus of claim 25, wherein movement of the at least one percussive action cutter beyond a predetermined relative axial position at least restricts fluid flow through a fluid port.

27. The apparatus of claim 25, wherein said movement corresponds to said at least one other cutter cutting ahead of said at least one percussive action cutter.

28. The apparatus of claim 25, wherein forward movement of the at least one percussive action cutter beyond a predetermined axial position relative to the at least one other cutter corresponds to said at least one percussive action cutter having cut ahead of said at least one other cutter.

29. The apparatus of claim 28, further comprising means responsive to said forward movement of the at least one percussive action cutter, said means being effective to at least reduce the percussive action of said at least one cutters in response to said forward movement.

30. The apparatus of claim 24, wherein the at least one percussive action cutter is normally retracted from a fully extended configuration.

31. The apparatus of claim 30, wherein the at least one percussive action cutter is spring biased towards the normally retracted position.

32. The apparatus of claim 1, wherein the at least one percussive action cutter comprises a mounting member in sliding sealing contact with a bore defined by a supporting body, whereby fluid pressure in the bore creates a pressure force acting on the cutter.

33. The apparatus of claim 1, wherein the apparatus is in the form of a shoe.

34. The drilling apparatus of claim 1, wherein said surface indicator comprises at least one fluid outlet which is closed if the percussive action cutter experiences elevated weight.

35. A drilling method comprising the steps:

providing a drilling apparatus comprising a cutting structure defined by at least one percussive action cutter and at least one other cutter;

urging the at least one percussive action cutter in a drilling direction by hydraulic pressure force while urging the at least one other cutter in a drilling direction by mechanical force; and identifying that the percussive action cutter is cutting at a faster rate than the at least one other cutter, wherein identifying that the percussive action cutter is cutting at a faster rate than the at least one other cutter comprises identifying a change in back pressure in drilling fluid at surface.

36. A drilling method comprising the steps:

providing a drilling apparatus comprising a cutting structure defined by at least one percussive action cutter and at least one other cutter;

urging the at least one percussive action cutter in a drilling direction by hydraulic pressure force while urging the at least one other cutter in a drilling direction by mechanical force;

identifying that the percussive action cutter is cutting at a faster rate than the at least one other cutter; and reducing the weight applied to the at least one other cutter.

37. A drilling apparatus comprising:

a cuffing structure defined by at least one percussive action cutter and at least one other cutter, the at least one percussive action cuffer being adapted to be urged in a drilling direction by hydraulic pressure force and the at least one other cutter being adapted to be urged in said drilling direction by mechanical weight, the cutters having a preferred relative position range; and a cutter position indicator providing an output signal if the relative position of the cutters moves outside said preferred range.

* * * * *

UNITED STATES PATENT AND TRADEMARK OFFICE

CERTIFICATE OF CORRECTION

PATENT NO. : 7,461,706 B2
APPLICATION NO. : 11/691151
DATED : December 9, 2008
INVENTOR(S) : Eddison It is certified that error appears in the above-identified patent and that said Letters Patent is hereby corrected as shown below:

Column 10

Line 19: “cuffing structure” should read --cutting structure--

Signed and Sealed this

Nineteenth Day of May, 2009

John Doll

JOHN DOLL
*Acting Director of the United States Patent and Trademark Office*